United States Patent [19]

Frenette

[11] 4,155,184

[45] May 22, 1979

[54] HEAVY DUTY SHEAVE WITH MANUFACTURERS IDENTIFICATION MEANS

[76] Inventor: Lionel G. Frenette, Gowing Rd., Hudson, N.H. 03051

[21] Appl. No.: 782,504

[22] Filed: Mar. 29, 1977

[51] Int. Cl.[2] ..... G09F 3/00

[52] U.S. Cl. ..... 40/309; 40/2.2

[58] Field of Search ..... 40/2 R, 2.2, 309

[56] References Cited

U.S. PATENT DOCUMENTS

| | | | |
|---|---|---|---|
| 1,275,669 | 8/1918 | Forbes | 40/2.2 X |
| 1,517,718 | 12/1924 | Feldner | 40/2.2 |
| 3,273,268 | 9/1966 | Blandford | 40/2.2 |
| 3,643,358 | 2/1972 | Morderosian | 40/2.2 |

*Primary Examiner*—Louis G. Mancene
*Assistant Examiner*—Wenceslao J. Contreras
*Attorney, Agent, or Firm*—Pearson & Pearson

[57] ABSTRACT

A heavy duty sheave especially for use in supporting the stresses and strains on a wire cable in loosening the frozen load of waste within a roll-off box, to permit discharge of the load, without breakage of the sheave is formed of a solid disc of hot rolled steel plate circumferentially butt welded to a pair of outer steel washers to form a cable groove of curved cross section. To avoid breakage of sheaves by substitution of weaker units, each sheave of the invention includes identification means recognizable by the manufacturer but not readily noted or discovered by the user.

3 Claims, 4 Drawing Figures

HEAVY DUTY SHEAVE WITH MANUFACTURERS IDENTIFICATION MEANS

RELATED APPLICATIONS

The sheave of this invention is intended for use in the Instant Load Release System of my U.S. Patent application Ser. No. 650,256 filed Jan. 19, 1976.

BACKGROUND OF THE INVENTION

The freeing of frozen loads of waste in the roll-off boxes now much used for compacting trash at retail installations has long been a problem despite the efforts of various patentees to provide cable pulled ejector bars which move along the bottom of the box to urge the load rearwardly. In my above mentioned patent application, not only does the tilting of the roll-off box on its tilt bed vehicle, apply tremendous tension on an ejector bar but extension cables anchored on the roof of the box and encompassing the front of the frozen load also must be tautened and pulled to squeeze and compress the load away from adherence to the front and side walls of the box.

The ejector bar devices of the prior art such as in U.S. Pat. No. 3,626,648 to Pioch of Dec. 7, 1971 and the device of my said patent application thus must have at least one sheave which will withstand the pull on the cable without breakage of the sides of the cable groove or of other parts of the sheave.

It has been found that commercially available sheaves are not satisfactory for the purpose and that the machining of a sheave of suitable dimensions from a solid steel block is too costly to be practical. It will also be understood that certain users of roll-off boxes may seek to substitute replacement sheaves of less cost and strength in instant load release systems of my invention, thereby encountering sheave abrasion, breakage failure, etc. to the detriment of the system.

SUMMARY OF THE INVENTION

In this invention the sheave is formed of a central, solid disc of flat, hot rolled, steel plate about three quarters of an inch thick and four inches in diameter flanked by a pair of commercially available solid, steel discs, or washers, about one quarter inch thick and six inches in diameter, the holes in the washers register with an axial bore in the central disc for mounting on a suitable pin, gudgeon or shaft to rotate.

The opposite diametrical faces of the central solid disc are flatwise against the adjacent diametrical faces of the outer discs or washers, and a circumferential, butt weld of arcuate outer configuration joins each outer disc to the central disc to form a unitary body with a sheave groove of curved cross section of substantially greater dimensions than the dimensions of the wire rope, or cable, received therein.

Not only is the sheave of the invention well able to withstand the stress and strain of the wire cable in freeing a frozen load, but it also includes identification means built in and integral so that weaker sheaves cannot be substituted without being noted by the manufacturer. The identification means is preferably a serial number indented or marked permanently in one of the abutting diametrical faces of the central or outer discs, within the confines of the welds and in the overlapping area not visible when the device is unitized. An alternate identification means is a deposit of a radioactive material in a recess in the unwelded, overlapping portion of the discs, the deposit being safe to the public but capable of being sensed by a geiger counter. A further identification means is the appearance configuration and style of the circumferential welds, the configuration of the weld surface being recognizable by the manufacturer as having been created by personnel of the manufacturer.

DESCRIPTION OF A PREFERRED EMBODIMENT

Figure 1:
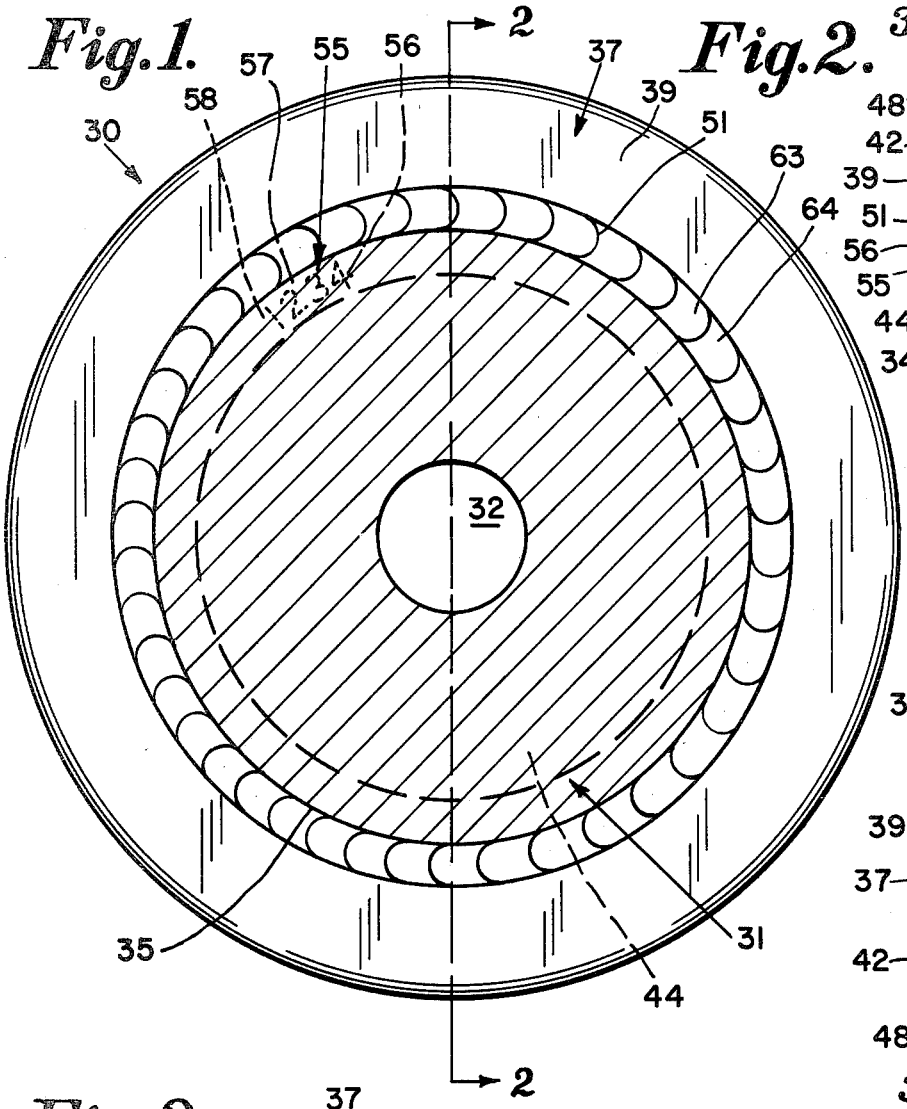
FIG. 1 is a front elevation of a sheave constructed in accordance with the invention in section on line 1—1 of FIG. 2.
Figure 2:
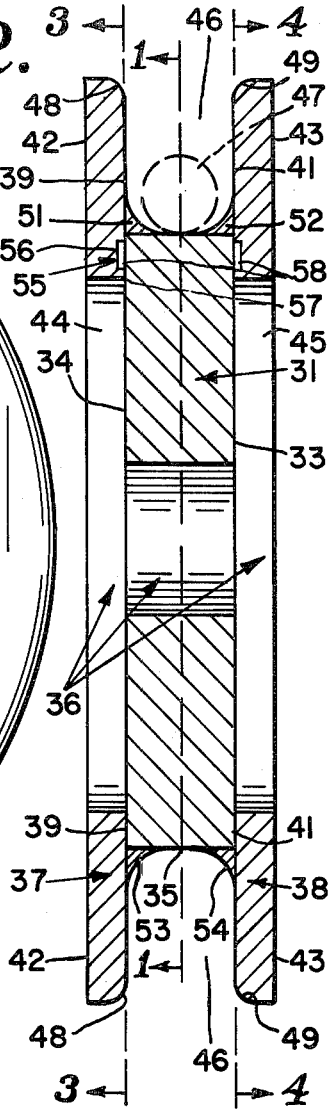
FIG. 2 is a side elevation of the sheave shown in FIG. 1, in section on line 2—2 of FIG. 1.
Figure 3:
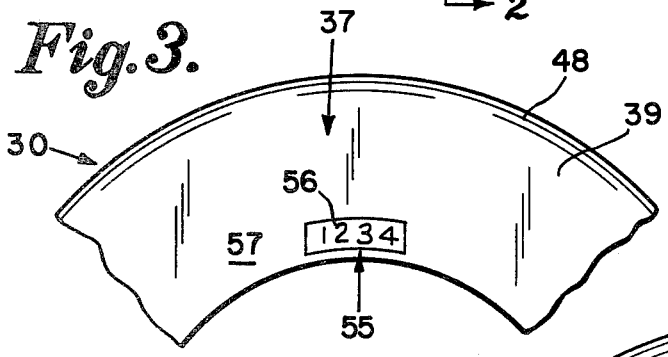
FIG. 3 is a fragmentary front view of the sheave, in section on line 3—3 of FIG. 2.
Figure 4:
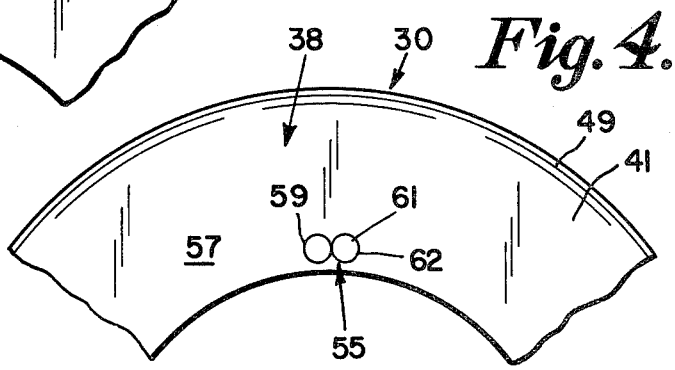
FIG. 4 is a fragmentary, rear view, in section on line 4—4 of FIG. 2.

As shown in the drawing, a heavy duty, unitary, sheave 30 of the invention includes a central, solid disc, or hub, 31 preferably formed, or cut, from flat, hot rolled, steel plate about three quarters of an inch thick and having a diamater of about four inches. The central disc is provided with an axial bore 32 of about three quarters of an inch diameter and includes the two opposite diametrical side walls 33 and 34 and the circumferential wall 35.

The unitary body 36 of the sheave 30, in addition to central disc 31, also includes a pair of identical, outer, solid discs, or washers, 37 and 38, of predetermined diameter greater than the diameter of the disc 31, such as about six inches. Each outer disc 37, or 38, includes an inner diametrical side wall 39 or 41 and an outer diameterical side wall 42 or 43. Each includes an axial bore 44 or 45 which registers with the axial bore 32 of the central disc 31 when the inner side walls 39 and 41 are each located flatwise against one of the opposite side walls 33 or 34 of the central disc 31. The outer discs, or washers 37 and 38 thus form a sheave groove 46 with the central disc 31, the groove 46 before welding being of rectangular cross section and about 11/16 inches in depth and 10/16 inches in width to accommodate a wire rope, or cable, 47 or about 8/16 inches in diameter.

The peripheral inner rims 48 and 49 of the outer discs 42 and 43 are rounded to avoid abrading the cable when the cable is slightly out of alignment with the sheave.

A pair of circumferential, butt welds 51 and 52 extend around the periphery of each opposite side of the central disc 31, partly on the opposite sides of the circumferential wall 35 and partly on the inner walls 39 and 41 to unite and join the three discs 31, 37 and 38 into the integral, unitary body 36 of the sheave 30.

As shown each weldment 51 and 52 has a curved outer face 53 or 54 to form a sheave groove of curved rather than rectangular cross section, thereby smoothly and freely seating a cable 47 without tightness, friction, abrasion or other damaging contact. The solid central disc, or hub 31 cannot be compressed, twisted or bent and therefore is able to withstand the unusual pressures to which it is exposed.

Identification means 55 preferably comprises a serial number, 56, indented or marked in the unwelded area 57 of an inner wall 39 or 41 of a disc 37 or 38 or in the opposite area 58 of a diametrical wall 33 or 34 of central disc 31. The areas 57 and 58 overlap each other and the serial number 56 is applied before the welding of the sheave so that the number is within the confines of the weld, invisible to the user and recognizable only by removing the weld or by x-ray of the sheave. Identification means 55 may also be a deposit 59 of a minute quantity of a radioactive material 61 in a recess 62 in an area such as 57 or 58 of a sheave 30 prior to the welding the unit. One suitable radioactive material is powdered ore containing a predetermined ratio of uranium so that each sheave will produce a predetermined count on a geiger counter. The indents of the serial number 56 can be filled with such powdered uranium ore so as to be picked up by the counter.

Still another identification means 55 is the appearance, physical configuration and style of the weldments 51 and 52 each weld 63 having characteristic surface features 64 by which it can be recognized by expert welders of the manufacturer of the sheave as a company product and not that of a competitor.

I claim:

1. A heavy duty, unitary, sheave, comprising:

a central, solid disc of predetermined diameter, said disc having a pair of opposite diametrical side walls and an axial bore;

a pair of outer solid discs, each of predetermined diameter greater than the diameter of said central disc, said outer discs each having a diametrical side wall located flatwise against one of said side walls of said central disc and each having an axial bore in registration with the axial bore of said central disc;

a pair of circumferential welds, each extending around said central disc, at the periphery of the opposite side walls thereof, and uniting said central disc to the side wall of the adjacent outer disc;

and identification means integral with said sheave for enabling recognition of the manufacturer thereof said identification means being a serial number indented in the material of one of said diametrical side walls of said sheave, within the confines of said weld so as to not be visible.

2. A heavy duty, unitary sheave comprising:

a central solid disc having an axial bore and a pair of outer, solid discs, each of greater diameter than the diameter of said hub end each having an axial bore in registration with the bore of said hub;

a pair of circumferential, butt welds, each extending around the periphery of one of the opposite sides of said central disc and uniting said disc to the adjacent outer discs and identification means located within the confines of at least one of said welds in the unwelded space between one of said outer discs and said central disc said identification means being serial number means located in said unwelded space and recognizable by removing said weld or by Xraying said sheave.

3. A heavy duty sheave comprising:

a unitary body formed of a central solid disc of flat rolled steel plate, having an axial bore, and a pair of outer solid steel washers of greater diameter than said central solid disc, said washers being circumferentially butt welded to said disc to jointly form a sheave groove of predetermined curved cross section adapted to receive a wire cable of smaller cross section;

and manufacturers identification means located in the space between at least one said washer and the adjacent side of said central disc within the confines of said groove and welds.

* * * * *